United States Patent [19]

Justus et al.

[11] Patent Number: 4,839,205

[45] Date of Patent: Jun. 13, 1989

[54] HEATED SUPPLY SHEAVES FOR WIRE COATING APPARATUS

[75] Inventors: Paul E. Justus; Mahammad F. Zaman, both of Fort Wayne, Ind.

[73] Assignee: Essex Group, Inc., Fort Wayne, Ind.

[21] Appl. No.: 78,726

[22] Filed: Jul. 27, 1987

[51] Int. Cl.[4] ..... D01D 1/00

[52] U.S. Cl. ..... 428/34.1; 242/47.5; 137/340

[58] Field of Search ..... 428/36; 118/60, DIG. 15, 118/DIG. 20; 242/47.5; 137/340; 165/88, 89

[56] References Cited

U.S. PATENT DOCUMENTS 1,760,516 5/1930 Norden ..... 118/60
2,701,765 2/1955 Codichini et al. ..... 118/60
3,479,689 11/1969 Kurzke et al. ..... 165/89
3,568,946 3/1971 Anderson et al. ..... 242/47.5
4,058,265 11/1977 Hedlund et al. ..... 242/47.5

FOREIGN PATENT DOCUMENTS 1069982 11/1959 Fed. Rep. of Germany ..... 118/60

*Primary Examiner*—Nancy A. B. Swisher

[57] ABSTRACT

A wire sheave particularly adapted for magnet wire coating apparatus. The sheave has an outer radial structure with an outer surface containing a wire groove. The outer radial structure also contains a chamber suitable for containing a liquid or gas. The apparatus is used to preheat wire before it passes through the coating solution.

6 Claims, 4 Drawing Sheets

HEATED SUPPLY SHEAVES FOR WIRE COATING APPARATUS

DESCRIPTION

1. Technical Field

The invention relates to wire coating apparatus.

2. Background Art

The production of multicoated wires, i.e. those having a plurality of coats of insulating material is produced by applying a plurality of coats of insulating materials in layers onto a wire. Commonly, these individual coats of insulating materials are applied by first passing the wire through an "enamel coating apparatus" and then the coat of insulating material is dried by subsequently passing the wire through a "drying and curing" oven.

The enamel coating apparatus has at least one "station" which contains at least one "die" located above a supply of "enamel" which usually contained in a vessel or trough. The enamel typically comprises a solution of polyamides, polyimides and polyester dissolved in an organic solvent such as phenol or cresylic acid. Wire passes through the trough, enamel adheres to the wire surface due to viscous forces, and it then passes through the die. The die itself has an internal passage which is dimensioned so to allow the wire and a desired thickness of enamel adhering to the wire to pass through. Any excess enamel adhering to the wire surface is refused passage by the die and returns to the trough.

After the application of a coat of enamel by passing the wire through the enamel and the die the wire next passes into the drying and curing oven which is typically a tall vertical oven. Within the oven a temperature profile is maintained so as to evaporate organics used as solvents in the enamel solution near the lower or "entrance region" of the oven where newly coated wire would enter the oven. At the upper or "exit region" of the oven, the temperature is maintained to cure the insulating materials within the enamel which have been newly applied onto the wire and from which the organics have been evaporated. The wire may then be returned to the enamel coating apparatus for application of an additional coat of enamel or if the desired coats of enamel have been applied the wire may be wound onto a product spool or spools.

To improve the economics of wire production, a "multiwire, multipass" wire insulating process which simultaneously produces a plurality of wires is most commonly used. This is accomplished by passing a plurality of wires from a supply spool or supply spools (or form a wire drawer or wire drawers) onto a set of sheaves located below or near the enamel coating apparatus before the location of a set of enamel dies. These sheaves are also known as "feed sheaves". The wires pass about the feed sheaves, through the trough containing the enamel solution, and then through a set of dies within the enamel coating apparatus. The wires pass through the dies (which limits the thickness of the enamel coat) and continues through the drying and curing oven until they are taken up by a second set of sheaves located after the oven exit. These sheaves are also known as "return sheaves". There the wires can be returned to a next set of feed sheaves located below or near the enamel coating apparatus before a second set of dies. Again the wires pass upward through the enamel solution and dies and then through the drying and curing oven where they are wound about a second set of return sheaves located beyond the oven exit. This process is repeated until the desired number of insulation layers have been applied to the wire, at which point the wire may be drawn off to a product spool or set of product spools which are used to collect the wire produced.

This method of wire production has proved to be satisfactory and is commonly employed throughout the wire insulating industry. However, the costs of operating vertical ovens, limitations on wire production rates, and the use of improved enamel solutions have encourage the development of improved methods and improved apparatus within the art.

DISCLOSURE OF INVENTION

It is an object of the invention to provide an apparatus which may be used to preheat wire before it passes through the enamel solution and dies within a wire coating apparatus.

It is another object of the present invention to provide an improved method of heating a wire within a wire coating apparatus.

These and other objects of the invention are realized by wire sheave having an outer radial structure, having an outer radial surface within which is contained at least one wire groove and a chamber at least partly contacting the outer radial structure suitable for containing a liquid or gas.

A further aspect of the invention is a method of heating up a wire in a wire coating apparatus which comprises the steps of providing a wire sheave having a central axial radial surface, an outer radial surface having at least one wire groove, and an annulus between the central axial radius surface and the outer radial surface, and passing at least one wire about the outer radial surface of the wire sheave while circulating a heat transfer liquid through the annulus at a temperature higher than the temperature of the wire passed about the outer radial surface of the wire sheave.

The foregoing, and other features and advantages of the present invention will become more apparent from the following description and accompanying drawings.

BEST MODE FOR CARRYING OUT THE INVENTION

Figure 1:
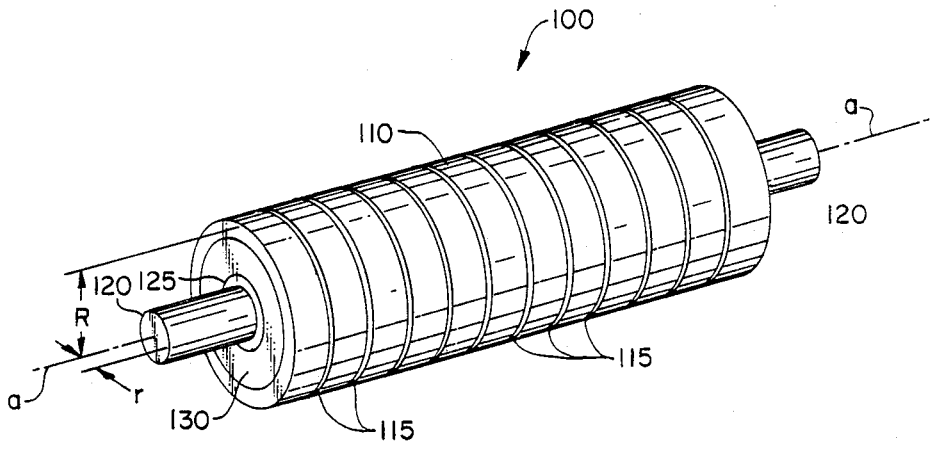
FIG. 1 is a perspective view of a wire sheave utilizing one aspect of the invention.

FIG. 1 is a perspective view of a wire sheave 100 having an outer radial structure 105 having an outer radial surface 110 within which are a plurality of wire grooves 115. The wire grooves 115 are situated parallel with respect to one another, and perpendicular to a common central axis, here denoted by line segments labelled "a". The wire grooves 115 are shown to be equidistantally spaced relative to one another, but any other spacing pattern may be utilized to suit the particular requirements of a specific application.

The wire sheave 100 is mounted on a central shaft 120 having a radius denoted by "r", and which has a central axis coinciding with the common central axis of the wire grooves which is denoted by the line segments labelled "a". About this central shaft 120 is located the central axial structure 125 of which one end is shown. The central axial structure 125 in FIG. 1 is a tubular structure mounted upon the shaft which has an internal diameter equal to or greater than the outer diameter of the central shaft 120 and an external diameter greater than its internal diameter. In the embodiment shown in FIG. 1 the central axial structure 125 extends along the length of the central shaft 120 for a length equal to the length of the outer radial structure 105.

Two end caps 130 (shown) and 135 (not shown) maintain the outer radial structure 105 and the internal axial structure 125 in a fixed position relative to one another.

The annulus (not shown) is contained within the space between the end caps 130, 135 the central axial structure 125 and the outer radial structure 105.

Figure 2:
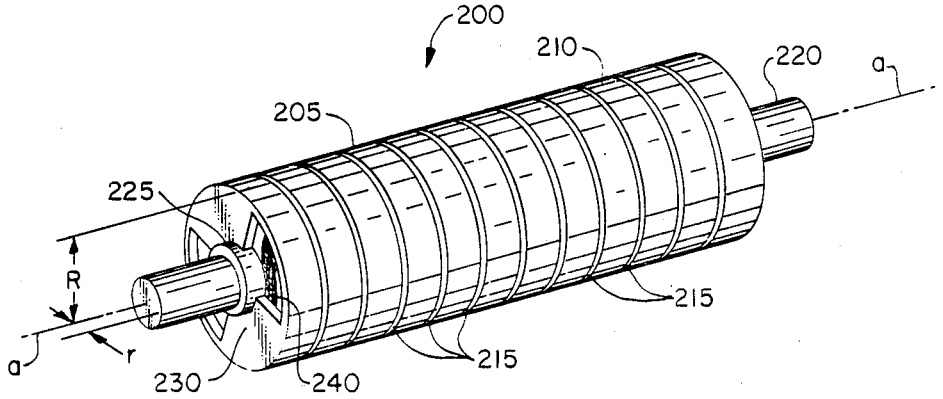
FIG. 2 is a perspective view of a wire sheave incorporating an alternative embodiment of the present invention.

FIG. 2 is a perspective view of a wire sheave 200 having an outer radial structure 205, having an outer surface 210 which contains a plurality of wire grooves 215. The outer radial structure 205 is fixed to two central axial structures, 225 (shown) and 226 (not shown) by end caps 230 (shown) and 235 (not shown). Here the central axial structures 225 and 226 are tubular structures having an internal diameter approximately equal to the diameter of the central shaft 220, an external diameter larger than its internal diameter, and a length approximately equal to or greater than the thickness of the end caps 230, 235. In this Figure, the end caps 230, 235, are fixed to the central shaft 220 and in turn the end caps 230, 235 are fixed to the central axial structures 225, 226 and to the outer radial structure 205. The end caps here 225, 230 function as a support frame and include portions which provide a view of the interior surface 235 of the outer radial structure 205, showing the use of an electro-chemical heat tape 240 positioned on the interior surface 235.

Figure 3:
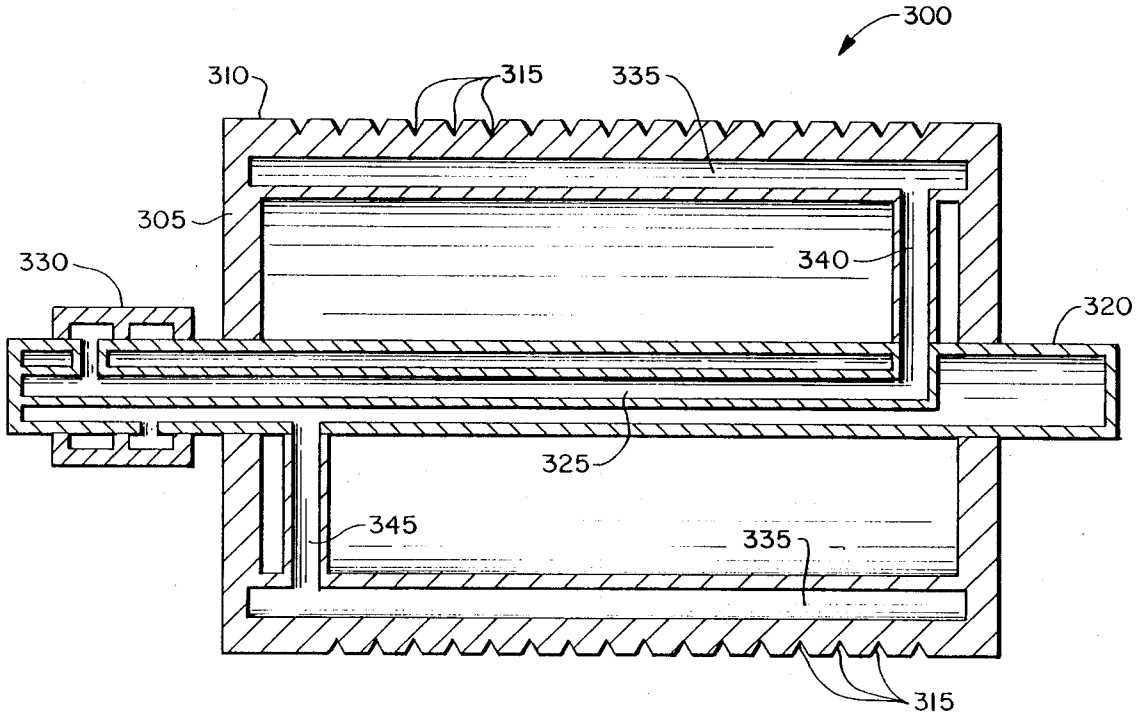
FIG. 3 is a cross-sectional view of a wire sheave incorporating one aspect of the invention which includes an annulus suitable for containing a liquid or gas.

FIG. 3 is a cross-sectional view of a wire sheave 300 having an outer radial structure 305 having an outer radial surface 310 within which are contained a plurality of wire grooves 315. The wire sheave 300 is mounted on a hollow central shaft 320 which contains an inner tube 325 communicating at one end with a rotatable fluid coupling 330 and with the annular chamber 335 via an inlet tube 340. The hollow central shaft 320 itself communicates with the annular chamber 335 via an outlet tube 345 and with the rotatable fluid coupling 330.

It should be noted that the annular chamber 335 is shown as an integral portion of the outer radial structure 305. However, other embodiments such as a separate but adjacent chamber in contact with the outer radial surface may also be utilized. Further these chambers take a variety of configurations such as pipes, tubes, or layered shells which have sealed common margins between which is an internal annulus. It should be of note that the location of the inlet tube 340 and the outlet tube 345 relative to the annular chamber are on opposite sides and ends of the annular chamber 335. This is preferred as such a configuration enhances good heat transfer, liquid or gas distribution and good heat transfer to the outer radial structure 305.

The rotatable fluid coupling 330 may be any coupling which provides means for input and output of a fluid or gas to a rotatable shaft having channels, conduits, or other flow directing means contained therein. The central shaft 320 shown is one such suitable shaft, but it is presented as an illustration of the best mode, but by no means is to be understood to be a limitation on the type of shaft which may be utilized within the scope of the invention.

Figure 4:
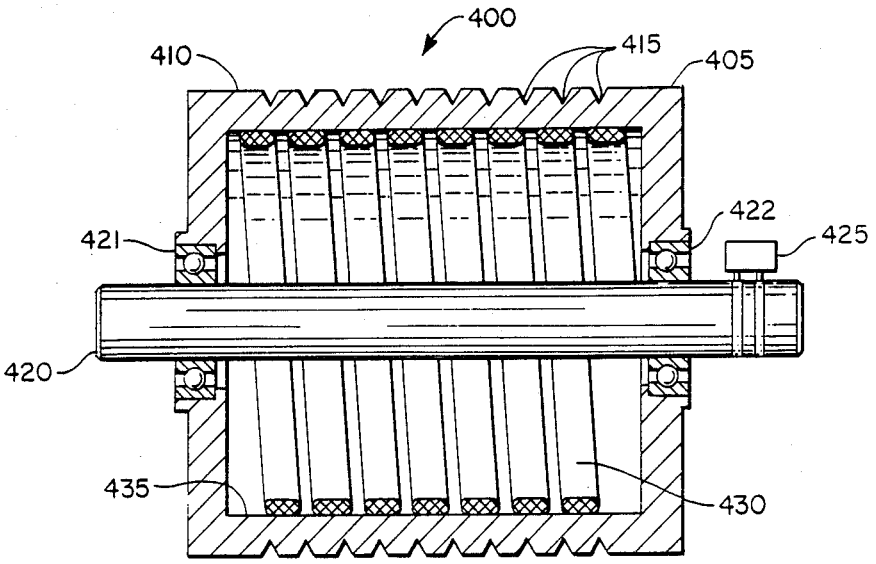
FIG. 4 is a cross-sectional view of a wire sheave incorporating an alternative embodiment of the invention wherein an electro-chemical heat strip is used.

FIG. 4 is a cross-sectional view of a wire sheave 400 having an outer radial structure 405, having an outer radial surface 410 within which are contained a plurality of wire grooves 415. The wire sheave 400 is mounted upon a central shaft 420 which is shown mounted on a pair of ball bearings 421, 422. At one end of the central shaft 420 is shown a rotatable electrical coupling 425 which provides means by which an electrical current may be continuously supplied to an electrical device 430 contained within the wire sheave 400.

Figure 5:
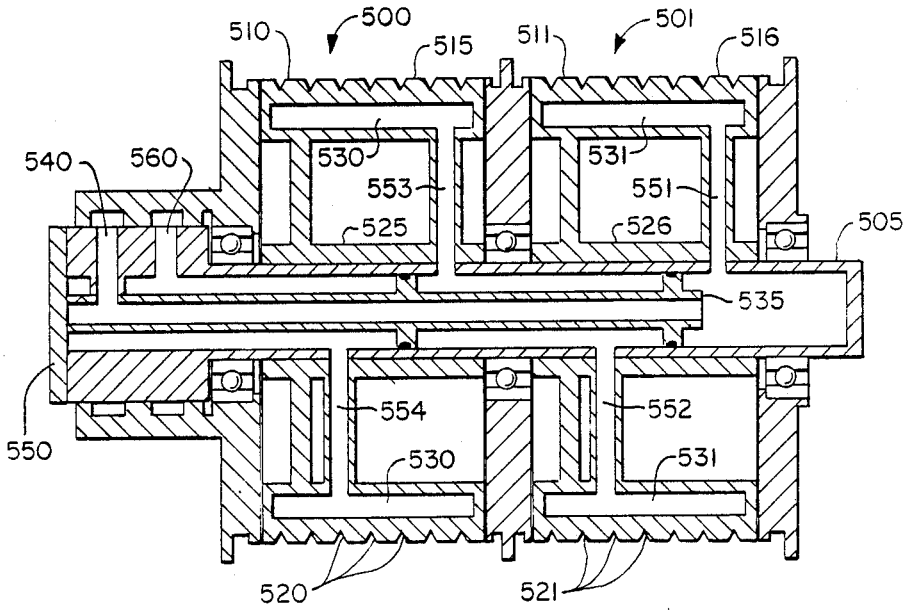
FIG. 5 is a cross-sectional view of two wire sheaves mounted on a common central shaft, each having an annulus suitable for containing a liquid or gas.

FIG. 5 is a cross-sectional view of two wire sheaves 500 and 501 mounted on a common central shaft 505 wherein each of the two wire sheaves 500, 501 has an outer radial structure 510, 511 having an outer radial surface 515, 516 within which are located a plurality of wire grooves 520, 521 and a central axial structure 525, 526 and an annular chamber 530, 531.

The central axial structures 525, 526 in this embodiment of the present invention are the inner sleeves of the wire sheaves 500, 501 which are fixed to the central shaft 505.

The central shaft 505 contains an inner tuber 535 which is used to direct the flow of a heat transfer liquid or gas from one end of the central shaft 505 from the inlet 540 of a rotatable fluid coupling 550 to the first inlet tube 551 of a wire sheave 501. The heat transfer liquid is pumped through the first inlet tube 551 through the annular chamber 531 of the wire sheave where it circulates through the outlet tube 552 of the wire sheave 501. The heat transfer liquid or gas then passes through the central shaft 505 where it enters the second inlet tube 553, circulates through the annular chamber 530 of the wire sheave 500 until it exits through the second outlet tube 554 to the central shaft 505 which conducts it to the rotatable fluid coupling 550 where it may be withdrawn through an exit port 560.

Figure 6:
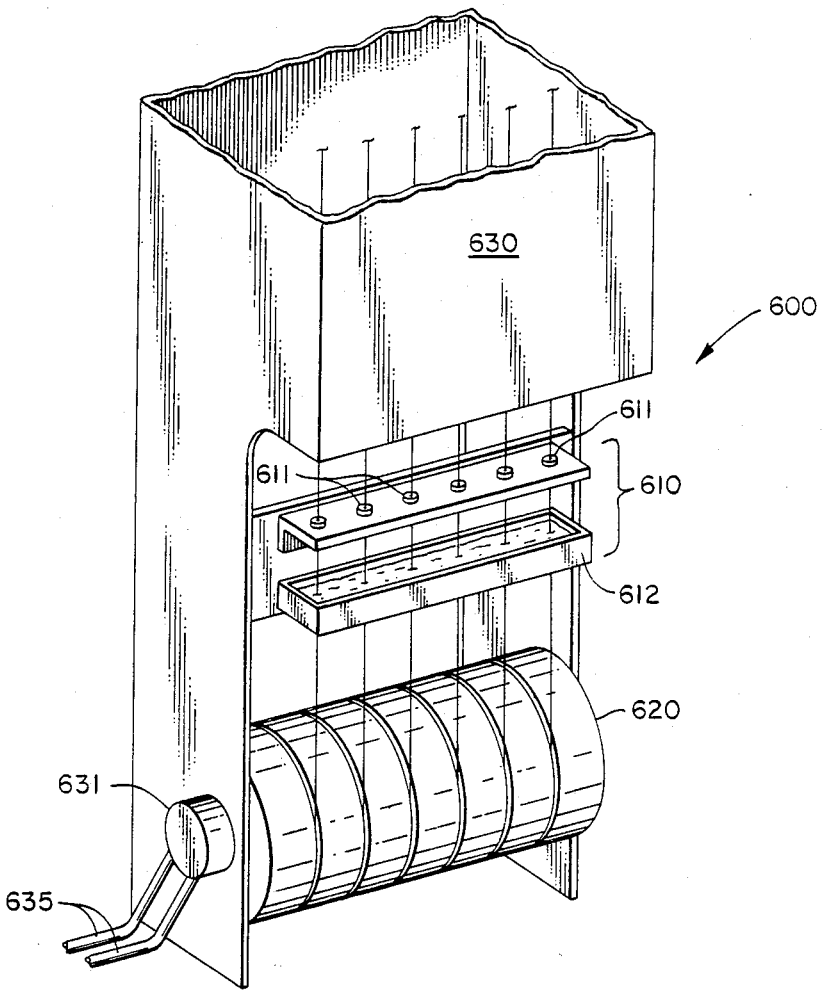

FIG. 6 illustrates a portion of a wire coating apparatus 600 having an enamel coating apparatus 610 containing a slip 612 for containing a supply of insulating enamel and a plurality of wire dies 611 positioned above the slip 612. The wire coating apparatus 610 is shown between a wire sheave 620 and a portion of a drying and curing oven 630. Also shown is a housing which contains a rotatable fluid coupling 530 to which a heat transfer liquid or gas is introduced and withdrawn via tubes or conduits 635.

In operation a heat transfer liquid or gas is circulated through the wire sheave 620 while the wire coating apparatus 600 is functioning.

It is preferred that the rate of circulation of a heat transfer liquid or gas, or the rate of heat generated by the electrical resistance tape or electro-chemical strip be sufficient so to bring the wire as near as possible to the temperature of the enamel contained within the slip 612. To achieve this end oil, water or steam may be used to heat the sheaves although alternative heat transfer liquids and gases may be used to satisfy the requirements for a particular application. Such elevated wire temperatures are desirable as they have been observed to reduce the amount of fluid drag as the wire passes through a die, which in turn limits the rate of wire production. Drag also increases the rate of wire breakage during the insulating process. Additionally, the use of a heated wire sheave imparts heat to the wire which aids in the evaporation of any organic solvents contained within the enamel which consequently results in a reduction of required oven size and increased wire production speed. Further the use of such a heated wire sheave reduces the amount of air entrainment within the enamel and within the enamel coat laid on the wire which results in undesirable "breaks" in the insulation layer.

Although this invention has been shown and described with respect to detailed embodiments thereof, it will be understood by those skilled in the art that various changes in form and detail thereof may be made without departing from the spirit and scope of the claimed invention.

We claim:

1. A wire sheave comprising:

a cylindrical outer radial structure, said structure having a plurality of wire grooves around the outer surface thereof;

a centrally located supply tube coaxial with said structure;

means for supplying heating medium through said supply tube;

a cylindrical wall spaced from said outer radial structure, forming an annular chamber therebetween;

said supply tube in fluid communication with said annular chamber;

a first confining tube coaxially surrounding said supply tube forming a flow path therebetween;

said annular chamber in fluid communication with said flow path; and said outer radial strucutre, said cylindrical wall and said first confining tube rotatable as a unit, but stationary with respect to each other, and means for discharging heating medium from said flow path comprising a fixed structure including a rotatable fluid coupling communicating with said flow path.

2. A wire sheave as in claim 1:

said annular chamber segmented into a plurality of subchambers; and said subchambers in series flow fluid communication.

3. A wire sheave as in claim 1:

each annular chamber having an inlet and an outlet; and said outlet located circumferentially 180 degrees from said inlet.

4. A wire sheave as in claim 2:

each subchamber having an inlet and outlet; and the outlet from each subchamber located circumferentially 180 degrees from the inlet to the subchamber.

5. A wire sheave as in claim 2:

a second confining tube coaxially surrounding said supply tube and longitudinally spaced from said first confining tube defining an intermediate path therebetween; and said intermediate path interposed between said subchambers in series flow relationship.

6. A wire sheave as in claim 5:

each subchamber having an inlet and outlet; and the outlet from each subchamber located circumferentially 180 degrees from the inlet to the subchamber.

* * * * *